US007354385B2

(12) United States Patent
Virji et al.

(10) Patent No.: US 7,354,385 B2
(45) Date of Patent: Apr. 8, 2008

(54) DISTALLY/PROXIMALLY-WEIGHTED JOINT SLEEVE

(75) Inventors: Ayaz Virji, Clearwater, FL (US); Naushad Virji, Longwood, FL (US)

(73) Assignee: Hexaslim, Inc., Largo, FL (US)

( * ) Notice: Subject to any disclaimer, the term of this patent is extended or adjusted under 35 U.S.C. 154(b) by 0 days.

(21) Appl. No.: 11/013,530

(22) Filed: Dec. 16, 2004

(65) Prior Publication Data

US 2006/0135326 A1 Jun. 22, 2006

(51) Int. Cl.
*A63B 21/065* (2006.01)
*A61F 5/00* (2006.01)

(52) U.S. Cl. ..... 482/105; 602/26

(58) Field of Classification Search ..... 482/105; 602/5, 6, 20, 23, 26; 2/16, 22; 600/15
See application file for complete search history.

(56) References Cited

U.S. PATENT DOCUMENTS

| | | | | |
|---|---|---|---|---|
| 2,241,833 | A | 5/1941 | Waller | |
| 4,247,097 | A | 1/1981 | Schwartz | |
| 4,287,885 | A * | 9/1981 | Applegate | 602/26 |
| 4,303,239 | A | 12/1981 | Walsh | |
| 4,344,620 | A | 8/1982 | Debski | |
| 4,384,369 | A | 5/1983 | Prince | |
| D278,455 | S | 4/1985 | Nosek | |
| 4,556,215 | A | 12/1985 | Tarbox | |
| 4,623,143 | A | 11/1986 | Wuellenweber | |
| D287,525 | S | 12/1986 | Durward | |
| 4,905,991 | A | 3/1990 | Alston | |
| 4,938,207 | A * | 7/1990 | Vargo | 602/26 |
| 4,953,856 | A * | 9/1990 | Fox, III | 482/105 |
| 4,966,365 | A * | 10/1990 | Winston | 482/105 |
| 4,974,398 | A | 12/1990 | Kaski | |
| 4,997,183 | A | 3/1991 | Winston | |
| 5,010,596 | A | 4/1991 | Brown et al. | |
| 5,063,913 | A * | 11/1991 | Nyi | 602/20 |
| 5,075,902 | A | 12/1991 | McReynolds | |
| 5,299,999 | A | 4/1994 | Brine | |
| 5,417,635 | A | 5/1995 | Sell | |
| 5,514,056 | A | 5/1996 | Ronca et al. | |
| 5,542,896 | A | 8/1996 | Qaiesi | |
| 5,553,322 | A * | 9/1996 | Cebo-Johnson | 2/69 |
| 5,555,562 | A | 9/1996 | Holt | |
| 5,667,466 | A | 9/1997 | Riley | |
| 5,683,335 | A | 11/1997 | Groves | |
| 5,784,716 | A | 7/1998 | Holt et al. | |
| 5,868,652 | A | 2/1999 | Spletzer | |

(Continued)

OTHER PUBLICATIONS

Free Attachable Weights Ankle—Wrist—Chest—Gloves, http://www.gungfu.com/cart-htm/exercise_gear_personal_equipment_free_weight_attachables.htm, 10 pages (visited Dec. 16, 2004).

(Continued)

*Primary Examiner*—Stephen R. Crow
*Assistant Examiner*—Allana Lewin
(74) *Attorney, Agent, or Firm*—Adam E. Crall; Smith Frohwein Tempel Greenlee Blaha LLC

(57) ABSTRACT

Various systems, methods, devices, etc. for simulating obesity and enhancing caloric expenditure in daily activities are provided. One embodiment is a device for wearing over a body joint to simulate obesity and enhance caloric expenditure in daily activities. One such device comprises a distally/proximally-weighted sleeve joint.

16 Claims, 4 Drawing Sheets

U.S. PATENT DOCUMENTS

| | | | | |
|---|---|---|---|---|
| 5,937,441 | A * | 8/1999 | Raines | 2/69 |
| 5,950,239 | A * | 9/1999 | Lopez | 2/115 |
| 5,961,430 | A | 10/1999 | Zuckerman | |
| 6,039,677 | A | 3/2000 | Spletzer | |
| 6,200,244 | B1 | 3/2001 | Cook | |
| 6,213,920 | B1 | 4/2001 | Ronca et al. | |
| 6,224,517 | B1 | 5/2001 | Dereszynski | |
| 6,244,997 | B1 | 6/2001 | Cook | |
| 6,258,014 | B1 | 7/2001 | Karecki | |
| 6,554,752 | B2 | 4/2003 | Cook | |
| 6,557,176 | B2 | 5/2003 | Franco-Sion | |
| 6,561,958 | B2 | 5/2003 | Pappert | |
| 2002/0010058 | A1* | 1/2002 | Myrick | 482/92 |
| 2003/0092544 | A1* | 5/2003 | Reed | 482/105 |
| 2006/0046913 | A1* | 3/2006 | Squittieri | 482/124 |

OTHER PUBLICATIONS

The SmartVest and Mind & Movement Training: Brought to you By Training Zone . . . , http://www.smartvest.net/smartvest.asp, 2 pages (visited Dec. 16, 2004).

The SmartVest and Mind & Movement Training: Brought to you By Training Zone . . . , http://www.smartvest.net/showArticle.asp?RecordNumber=64&abr=TS, 2 pages (visited Dec. 16, 2004).

Wearable Weights, BodyTrends.com, http://www.bodytrends.com/products/legweights/, 2 pages (visited Dec. 16, 2004).

* cited by examiner

DISTALLY/PROXIMALLY-WEIGHTED JOINT SLEEVE

BACKGROUND

Obesity is a growing, world-wide epidemic. Studies suggest that more than 60% of Americans are either overweight or obese. Obesity results in nearly 300,000 deaths per year in the United States. It is well established that obesity is a major risk factor for many serious diseases, including coronary heart disease, stroke, diabetes, breast cancer, colon cancer, ulcer-related diseases, gallbladder disease, osteoarthritis, prostate cancer, major depressive disorders, and chronic pain disorders, to name a few.

The core fundamentals of any obesity intervention and/or weight loss program involve reducing calorie intake (dieting) and increasing calorie utilization (exercise). In other words, in order to lose weight, you must expend more calories than you consume over a given time period. While the theories of weight loss are known, the fact remains that the majority of individuals fail in their attempts to lose and maintain an appreciable amount of weight loss. One noteworthy reason for the low success rates is that dieting and/or exercise require significant lifestyle alterations and dedication. Not all people that desire to lose weight (and maintain the weight loss) have the self-discipline, desire, etc. to follow through with a particular dieting and/or exercise regimen. The theory behind weight loss may be simple, but statistics show that executing and maintaining a plan is a different story.

SUMMARY

Various systems, methods, devices, etc. for simulating obesity and enhancing caloric expenditure in daily activities are provided. One embodiment is a device for wearing over a body joint to simulate obesity and enhance caloric expenditure in daily activities. One such device comprises a distally/proximally-weighted sleeve joint.

Another embodiment is an obesity simulation device comprising a weighted, form-fitting sleeve to be comfortably worn over a body joint. The sleeve has a plurality of weights distributed distally and proximally relative to a middle portion of the form-fitting sleeve.

Yet another embodiment is a device for wearing over a body joint to simulate obesity and enhance caloric expenditure in daily activities. One such device comprises: a substantially cylindrical form-fitting sleeve to be comfortably worn over a body joint and adjacent proximal and distal areas of the body joint, the sleeve comprising a middle portion that at least partially covers the body joint, a proximal portion that at least partially covers the proximal area, and a distal portion that at least partially covers the distal area; and means for removably attaching a first plurality of weights to the proximal portion and a second plurality of weights to the distal portion.

BRIEF DESCRIPTION OF THE DRAWINGS

Other aspects, advantages and novel features of the invention will become more apparent from the following detailed description of exemplary embodiments of the invention when considered in conjunction with the following drawings.

DETAILED DESCRIPTION

Various systems, methods, devices, etc. for simulating obesity and enhancing caloric expenditure in daily activities are provided. A more detailed description of the obesity epidemic and the science and theory behind weight loss management are provided in the *The Skinny Book: The 6-Step Methodology for Weight Management*, Verona Publishing, Inc., 2004 by co-inventor Dr. Ayaz Virji, which is hereby incorporated by reference in its entirety. Various embodiments are described below with respect to FIGS. 1-9. As an introductory matter, however, an exemplary embodiment will be briefly described.

In general, the exemplary embodiment comprises a distally/proximally-weighted joint sleeve (DPWJS) that may be easily and comfortably worn by a person over a body joint (e.g., knee, elbow, etc.). The DPWJS supports a predetermined amount of "simulated" body weight which is anatomically distributed relative to the body joint (e.g., proximal and distal to the body joint). The amount of the simulated body weight may be clinically defined to simulate the anatomy and/or physiology of the target body joint. For instance, a DPWJS may be designed with a larger proportion of the weight disposed on a proximal portion of the sleeve. One of ordinary skill in the art will appreciate that the physiological and/or anatomical distribution of the weight on the DPWJS more accurately simulates an obese environment. Furthermore, the proximal and distal weight distribution relative to the body joint may promote enhanced caloric expenditure, while maintaining the freedom of motion needed for daily activities.

In this regard, the DPWJS is made of a lightweight, flexible, and breathable fabric to promote a form-fitting and comfortable engagement between the sleeve and the body joint. The slim profile of the DPWJS also enables the sleeve to be discreetly worn underneath existing clothing during activities of daily living.

Figure 1:
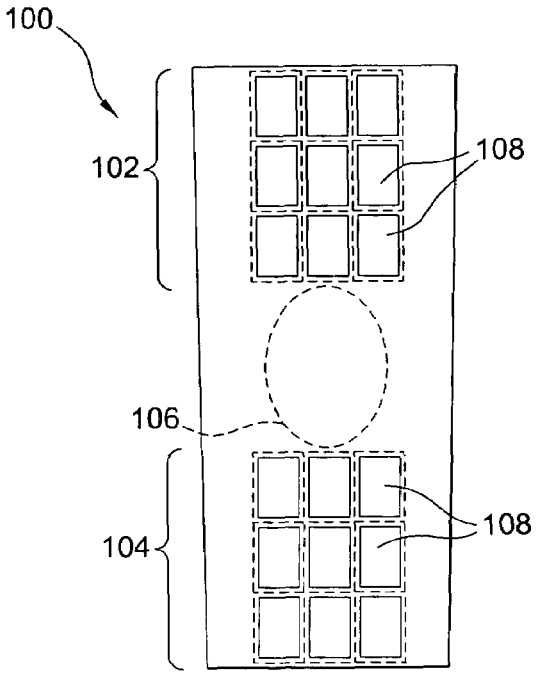
FIG. 1 is a front view of one embodiment of a distally/proximally-weighted elbow sleeve, which may be comfortably worn by a patient to simulate obesity and enhance caloric expenditure during daily activities.
Figure 2:
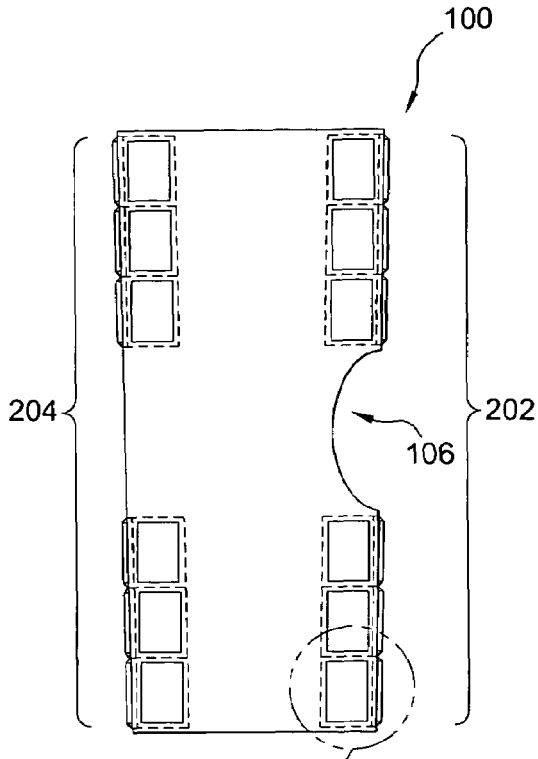
FIG. 2 is a side view of the distally/proximally-weighted elbow sleeve of FIG. 1.
Figure 3:
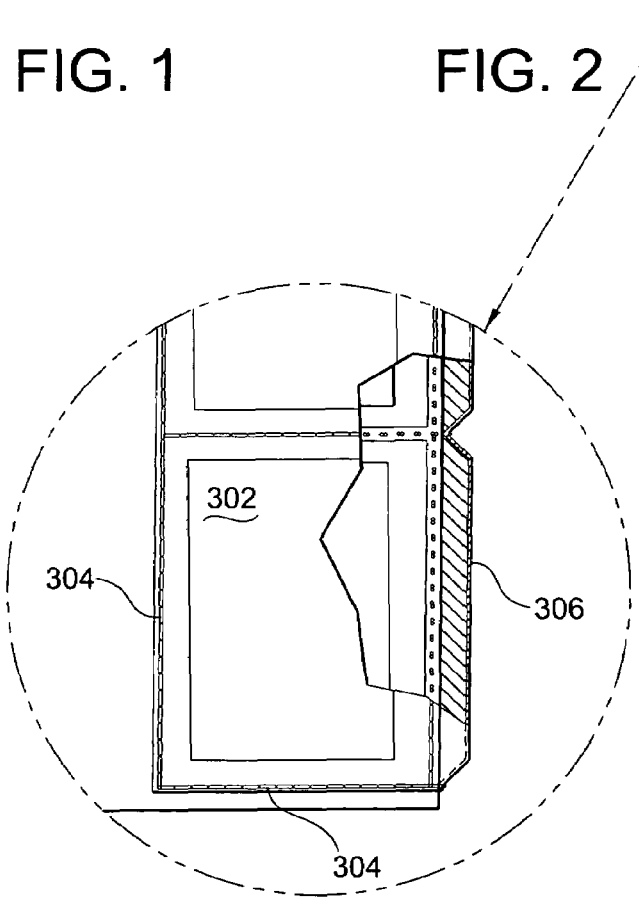
FIG. 3 is an exploded view of an embodiment of one of the weight-receiving pockets of the distally/proximally-weighted elbow sleeve of FIGS. 1 & 2.

FIGS. 1-3 illustrate an embodiment of a DPWJS 100 for use on an elbow joint. As best illustrated in FIGS. 1 & 2, DPWJS 100 comprises a substantially cylindrical sleeve that is sized and configured for a form-fitting and comfortable engagement with an elbow joint. A proximal portion 102 of DPWJS 100 may have a larger diameter than a distal portion 104 to account for the relative anatomical and/or physiological differences adjacent the elbow joint. In other words, the cross-sectional width of DPWJS 100 may taper inward from proximal portion 102 to distal portion 104. DPWJS 100 may also comprise a substantially circular or elliptical hole (e.g., cut-out 106) in a middle portion of the sleeve between proximal portion 102 and distal portion 104. When DPWJS 100 is worn over the elbow joint, cut-out 106 aligns with the joint to promote comfort.

It should be appreciated that DPWJS 100 may be made of a variety of materials. In one embodiment, DPWJS 100 is made of a lightweight, flexible, and breathable fabric. It should be appreciated that DPWJS 100 may comprise any of the following, or other, materials: neoprene, spandex fiber, polyester microfiber, polyester/nylon blend, performance fabrics/blends, etc.

As mentioned above, DPWJS 100 supports a predetermined amount of "simulated" body weight which is proximally and distally distributed relative to the elbow joint. Although the amount of the simulated body weight may be varied to accommodate various clinical situations, individuals, etc., in one embodiment approximately 2-3 pounds are distributed on proximal portion 102 and distal portion 104. It should be appreciated that the simulated body weight may be anatomically and/or physiologically distributed in such a manner that more weight is disposed on proximal portion 102 than distal portion 104. By way of example, 60% of the simulated weight may be disposed on proximal portion 102 and 40% disposed on distal portion 104.

The simulated body weight may be supported on DPWJS 100 in various ways. As illustrated in FIGS. 1 & 2, the simulated body weight may be distributed in a matrix of pockets 108 disposed on the respective proximal and distal portions of DPWJS 100. Pockets 108 may be integrally formed in the sleeve, attached to the outer and/or inner surface of the sleeve, or otherwise supported by the sleeve. In the embodiment illustrated in FIG. 3, a pocket 108 is defined by a pocket base 302 that is stitched to the outer surface of the sleeve via stitching/thread 304. Regardless of the particular size, structure, configuration, etc., the purpose of pockets 108 is to support corresponding weight member(s), while maintaining a very slim design feasible for daily wear under clothing. The weight member(s) may be configured in various ways. By way of example, pockets 108 may house a solid material, liquid or gel-filled capsules, solid granules, etc. In one embodiment, the weight member(s) are designed with a slim, cross-sectional profile and the pocket(s) 108 are designed to hold the weight members close to the body to minimize uncomfortable shifting as the individual moves.

In alternative embodiments (FIG. 3), pockets 108 may be configured so that the weight member(s) may be easily inserted and removed. In this regard, the amount of the simulated body weight may be easily modified. As illustrated in FIG. 3, pockets 108 may include a flap 306 that covers an opening to the interior of the pocket. Flap 306 may also include a means for securing it to the sleeve to support the respective weight member(s).

The location(s) of the weight member(s) on proximal portion 102 and distal portion 104 may also be varied. As illustrated in FIGS. 1 and 2, pockets 108 may be disposed an anterior portion 202 and a posterior portion 204 of DPWJS 100. Thus, DPWJS 100 may include pockets 108 on an anterior/proximal portion, an anterior/distal portion, a posterior/proximal portion, and a posterior/distal portion. One of ordinary skill in the art will appreciate, however, that pockets 108 may be disposed anywhere on proximal and distal portions 202 and 204.

Figure 6:
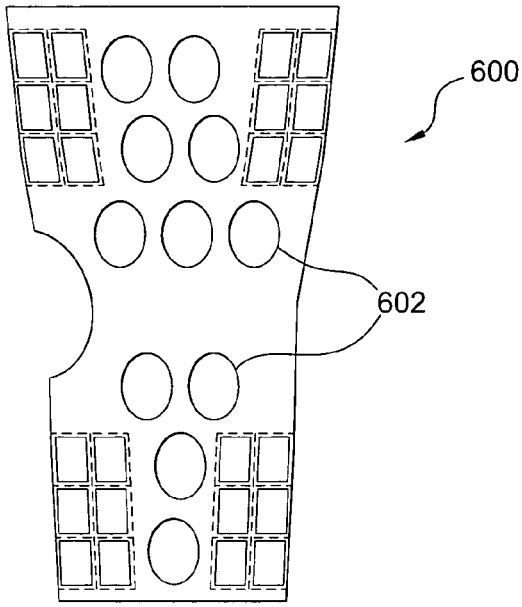
FIG. 6 is a front view of another embodiment of a distally/proximally-weighted knee sleeve.
Figure 4:
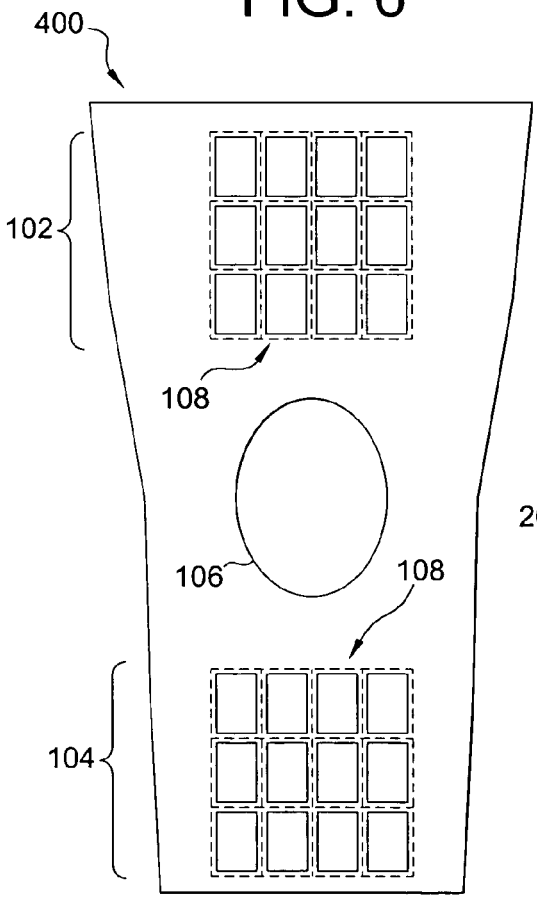
FIG. 4 is a front view of an embodiment of a distally/proximally-weighted knee sleeve, which may be comfortably worn by a patient to simulate obesity and enhance caloric expenditure during daily activities.
Figure 5:
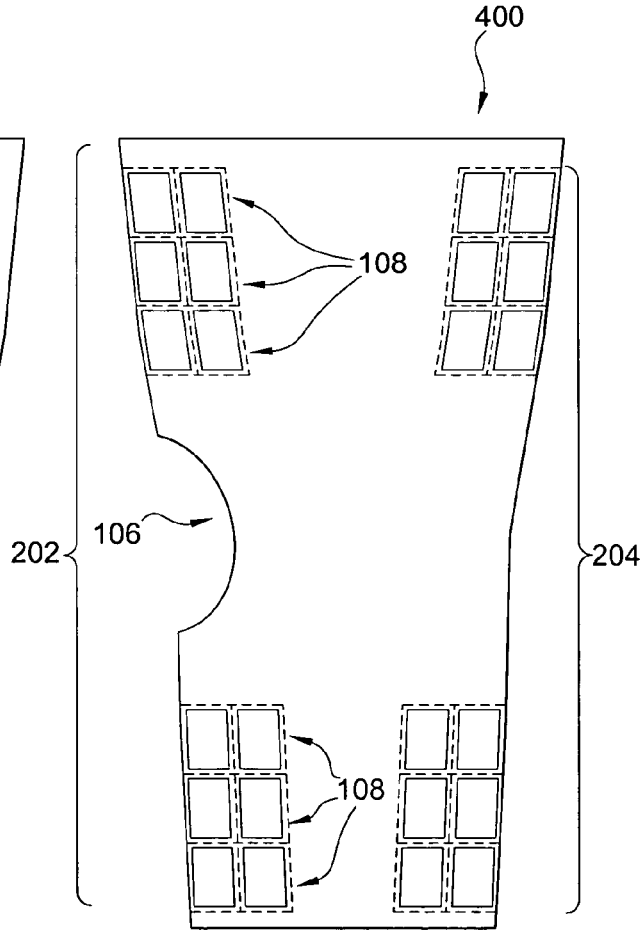
FIG. 5 is a side view of the distally/proximally-weighted knee sleeve of FIG. 4.

FIGS. 4-6 illustrate another embodiment of a DPWJS 400 for covering a knee joint. DPWJS 400 is configured in much the same manner as described above relative to the elbow joint. However, it should be appreciated that the size, dimensions, etc. of DPWJS 400 may be altered to accommodate the anatomical and/or physiological differences between the elbow joint and the knee joint. When implemented as a knee joint sleeve, the amount of the simulated body weight may be increased and/or the distribution of the body weight may be modified. For instance, in one embodiment, the amount of the simulated body weight added to DPWJS 400 is approximately between 4 to 5 pounds.

FIG. 6 illustrates another embodiment of a DPWJS 600 for covering a knee joint. DPWJS 600 is configured in much the same manner as DPWJS 400—with the exception of the addition of breathe-holes 602 to promote additional comfort for longer-term use of the sleeve.

Figure 7:
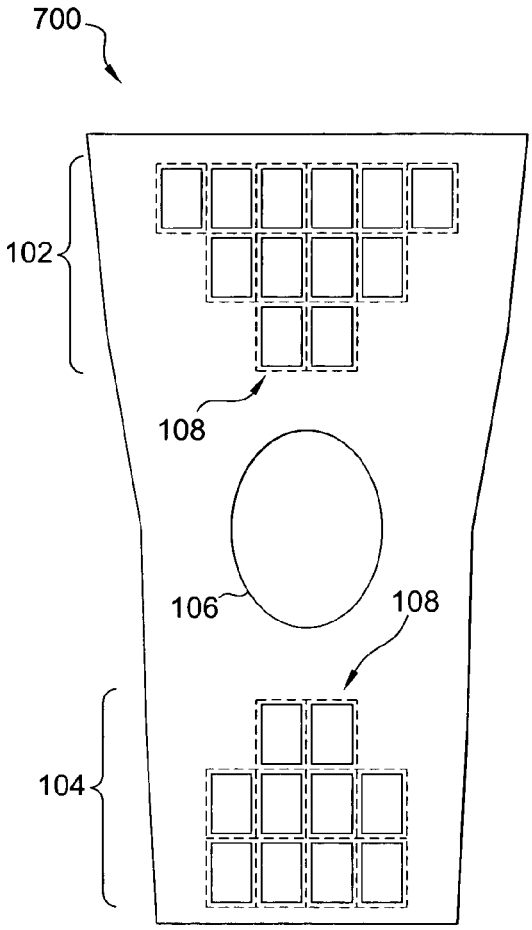
FIG. 7 is a front view of another embodiment of a distally/proximally-weighted knee sleeve illustrating an example of a relative proximal and distal weight distribution for simulating endogenous skeletal muscle.
Figure 8:
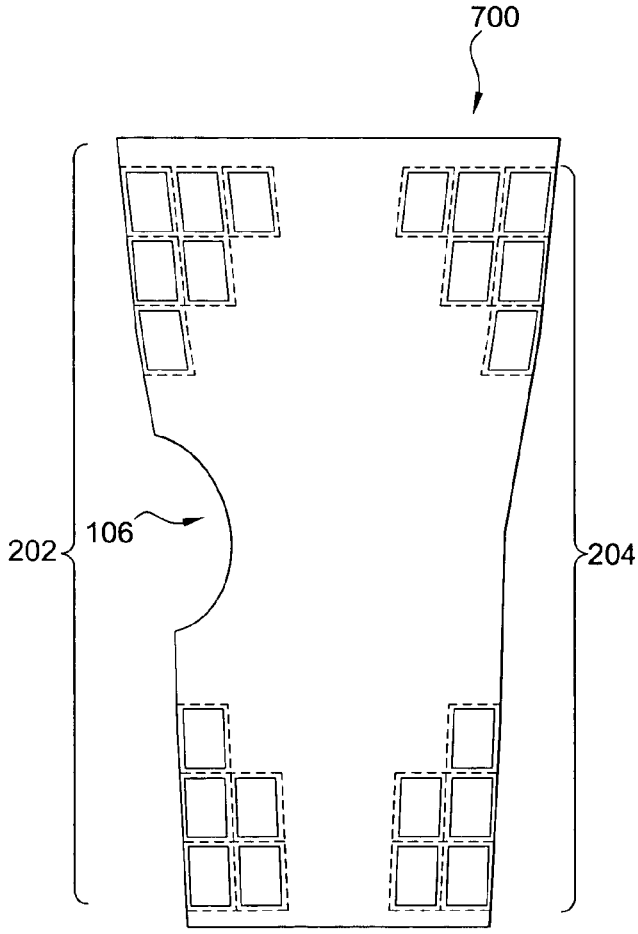
FIG. 8 is a side view of the distally/proximally-weighted knee sleeve of FIG. 8.

As mentioned above, the amount of the simulated body weight may be modified as needed. FIGS. 7 and 8 illustrate another embodiment of a DPWJS 700 for a knee joint. In this embodiment, the amount and distribution of the simulated body weights on proximal portion 102 and distal portion 104 are configured to simulate the endogenous skeletal muscle adjacent the knee joint. As best illustrated in FIG. 7, proximal portion 102 includes more pockets 108 than distal portion 104 and, therefore, may support more weight. Furthermore, the matrix of pockets 108 are configured so that there are more pockets 108 further away from the knee joint. In other words, the matrix of pockets 108 may be tapered toward the knee joint to more accurately simulate the distribution of endogenous skeletal muscle on proximal and distal portions of the knee joint, respectively. In a similar manner, the relative number and distribution of pockets 108 (and weight members) on anterior portion 202 and posterior portion 204 may be configured in any suitable clinical manner.

Figure 9:
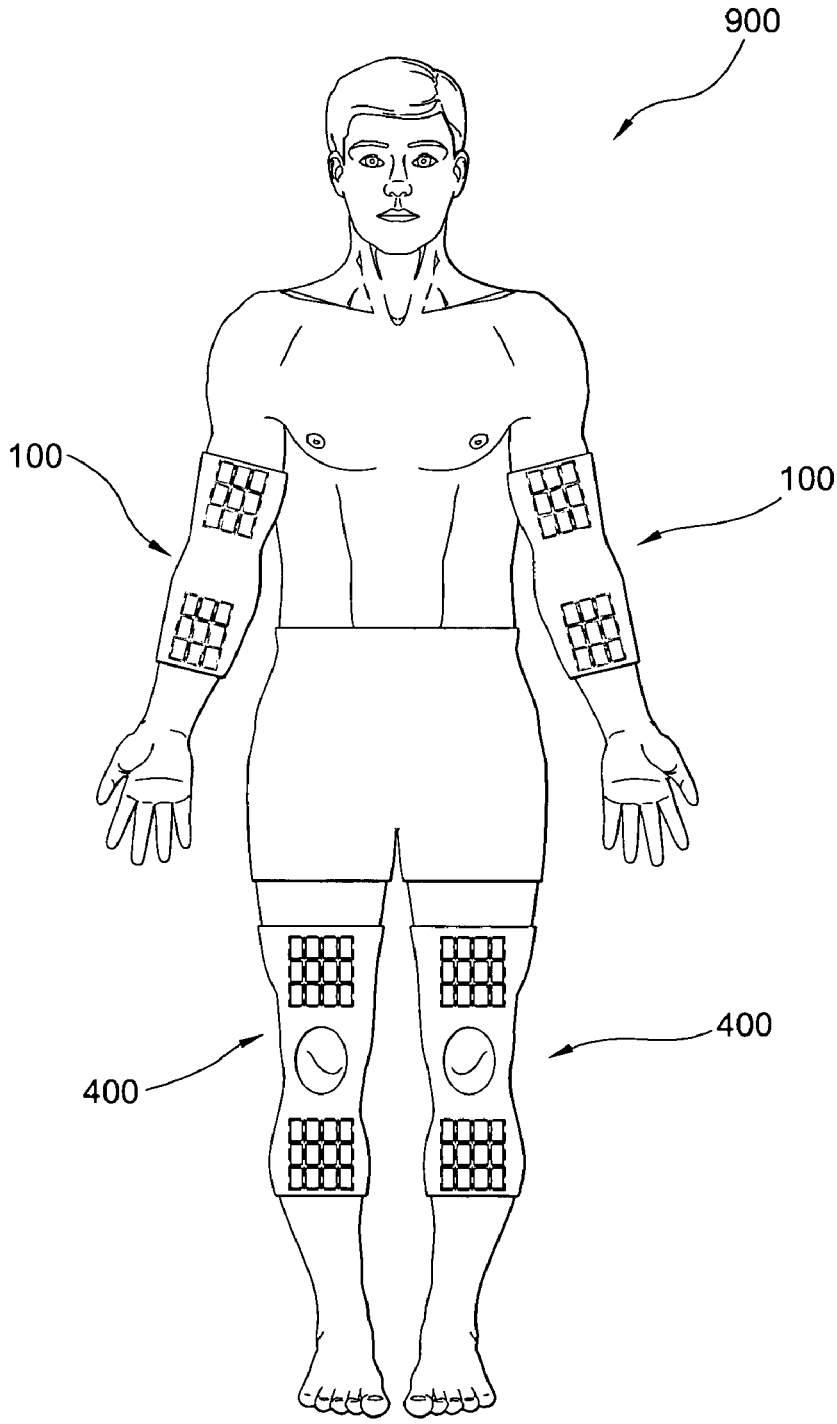
FIG. 9 is a front view of a weight loss patient wearing distally/proximally-weighted joints sleeves on both elbows and knees.

As illustrated in FIG. 9, multiple proximally/distally-weighted joint sleeves may be employed by an individual to leverage the effects of cumulative caloric expenditure at multiple body joints, as well as to more accurately simulate the overall obese environment.

One of ordinary skill in the art will appreciate that regular use of the various embodiments of a proximally/distally-weighted joint sleeve (on one or more body joints) may enhance caloric expenditure due to the additional simulated body weight and the proximal/distal distribution of the weight relative to the body joints. It should be noted that, although exercise is an important part of overall health, it accounts for a relatively small percentage of daily caloric expenditure for most individuals. The amount of time one can realistically dedicate to exercise is limited due to health, family, career, lifestyle factors, etc. For instance, a typical individual expends only approximately 20% of daily caloric expenditure through exercise. The largest percentage of daily caloric expenditure comes from the basal metabolic rate (BMR). The BMR (which accounts for approximately 70% of daily caloric expenditure) is the daily energy required by the body to exist and maintain minimal function. This includes energy needed for breathing, blood circulation, maintenance of core body temperature, etc.

In this regard, the various embodiments of proximally/distally-weighted joint sleeves target BMR, rather than expenditure via exercise (although they may also be used during exercise to further enhance caloric expenditure).

Enhanced caloric expenditure may be accomplished though a unique concept of Activities of Daily Living Resistance (ADLR), which is one of the core principles for DPWJS. Non-Exercise Activity Thermogenesis (NEAT) is the daily energy expenditure accomplished through physical activity involving non-volitional exercise, otherwise known as Activities of Daily Living (ADL). These include activities such as opening a door, walking to the car, pacing while on the phone, walking the dog, running errands, doing housework, etc. NEAT has been validated as a potentially significant source of Non-Resting Energy Expenditure (NREE) and resistance to weight gain through studies done at the Mayo Clinic (Levin J A, et al, Am J Clin Nutr 2000, December; 72(6):1451-4, Levine, J A, et al. Science 1999, January; 283(5399):212-4), which is hereby incorporated by reference in its entirety. The various embodiments of a DPWJS are designed to significantly enhance NEAT by adding ADLR to one's daily routine, thus significantly increasing total daily energy expenditure in a virtually effortless design. They are designed to be used during regular Activities of Daily Living described above. They are designed slim and comfortable enough to be worn under a variety of clothing types and to be worn unnoticeably on a daily basis.

It should be appreciated that the various embodiments of a DPWJS also work to fight obesity by simulating the obese environment. Weight is distributed in a physiologic manner around major muscle groups of the upper and lower extremeties. As obese individuals lose weight they also lose lean muscle mass because they are carrying around much less weight in their day-to-day lives, thereby reducing their BMR. In addition, burning calories becomes more difficult for the same reason. Therefore, weight loss often comes to a halt, and may reverse. Loss of lean muscle mass during dieting and weight loss results in reduced BMR, essentially yielding a slower metabolism.

The various embodiments of DPWJS described above apply exogenous weight to the body in a physiologic way to model the bodies major muscle groups. These muscle groups include, but are not limited to the upper extremity groups (biceps bracii, triceps, flexor and extensor muscles of the forearm) and the lower extremity groups (quadriceps femoris, hamstrings, tibialis anterior, and tibialis posterior). This systematic application of exogenous weight fuels the calorie burning process by requiring many extra calories with any physical action taken. In addition, it enhances the BMR by sustaining lean muscle mass in the appendicular skeletal muscle of the extremeties (which houses the bodies greatest portion of lean muscle tissue) through added resistance with virtually every consequential physical movement.

One of ordinary skill in the art will appreciate that the use of various embodiments of a DPWJS accomplishes two major goals: (1) maintenance of the BMR during weight loss; and (2) enhancement of NEAT through ADLR—thus promoting weight loss. A DPWJS accomplishes these goals through four major modalities: (1) bilateral, symmetric exogenous weight added to the body; (2) weight is distributed along major joints of the upper and lower extremeties; (3) weight wraps the body along the major muscle groups of the extremeties simulating physiologic endogenous skeletal muscle; and (4) weight is packaged in a thin cylindrical sleeve that is virtually unnoticeable under clothing—making it practical for daily use.

Although this disclosure describes the invention in terms of exemplary embodiments, the invention is not limited to those embodiments. Rather, a person skilled in the art will construe the appended claims broadly, to include other variants and embodiments of the invention, which those skilled in the art may make or use without departing from the scope and range of equivalents of the invention. For example, the DPWJS may be appropriately sized and configured for any suitable joint (e.g., knee, elbow, etc.) and the simulated body weight may be distributed in any suitable manner on the sleeve. Furthermore, the principles underlying the construction, operation, benefits, etc. of the DPWJS may be extended to other body parts and other wearable devices, garments, etc. to simulate the obese environment and enhance caloric expenditure.

What is claimed is:

1. A device for wearing over a body joint to simulate obesity and enhance caloric expenditure in daily activities, the device comprising:

a substantially cylindrical form-fitting sleeve to be comfortably worn over a body joint and adjacent proximal and distal areas of the body joint, the sleeve comprising a middle portion that at least partially covers the body joint, a proximal portion that at least partially covers the proximal area, and a distal portion that at least partially covers the distal area; and means for removably attaching a first plurality of solid weights to the proximal portion and a second plurality of solid weights to the distal portion, the first and second plurality of solid weights spaced apart from each other and anatomically distributed on the corresponding portion of the form-fitting sleeve in a tapered arrangement toward the middle portion of the form-fitting sleeve so that the amount of weight on the form fitting sleeve generally increases away from the middle portion to generally simulate the relative distribution of endogenous skeletal muscle on the adjacent proximal and distal areas of the body joint when the device is worn.

2. The device of claim 1, wherein the substantially cylindrical form-fitting sleeve is adapted to be comfortably warn over one of a knee and an elbow.

3. The device of claim 1, wherein the substantially cylindrical form-fitting sleeve comprises a lightweight, breathable fabric.

4. The device of claim 1, wherein the ratio of the amount of weight of the first plurality of weights to the amount of weight of the second plurality of weights generally simulates the ratio of the weight of endogenous skeletal muscle on the proximal and distal areas of the body joint.

5. The device of claim 4, wherein the ratio is approximately equal to 1.5.

6. An obesity simulation device for enhancing caloric expenditure in non-exercise daily activities, the obesity simulation device comprising a weighted, form-fitting sleeve to be comfortably worn aver a body joint, the weighted, form-fitting sleeve having a plurality of weights anatomically distributed in a tapered matrix relative to the body joint on areas of the form-fitting sleeve which overlay the endogenous skeletal muscle on adjacent proximal and distal areas of the body joint when the device is worn wherein the tapered matrix comprises a plurality of row of weights above and below the body joint.

7. The obesity simulation device of claim 6, wherein the weighted, form-fitting sleeve is adopted to be comfortably worn over one of a knee and an elbow.

8. The obesity simulation device of claim 6, wherein the weighted, form-filling sleeve comprises an opening in the middle portion for receiving the body joint.

9. The obesity simulation device of claim 6, wherein the amount of weight in each row increases away from the body joint.

10. The obesity simulation device of claim 9, wherein the ratio of the weight associated with the first portion and the weight associated with the second portion simulates the relative amount of endogenous skeletal muscle on the proximal and distal areas of the body joint.

11. The obesity simulation device of claim 6, wherein the plurality of weights ore removably stored in a plurality of pockets.

12. The obesity simulation device of claim 11, wherein the plurality of packets are stitched in an outer surface of the weighted, form-fitting sleeve.

13. The obesity simulation device of claim 6, wherein the plurality of weights comprise flat weight members.

14. A device for wearing over a body joint to simulate obesity and enhance caloric expenditure in daily activities, the device comprising:

a substantially cylindrical form-fitting sleeve to be comfortably worn over a body joint and adjacent proximal and distal areas of the body joint, the sleeve comprising a middle portion that at least partially covers the body joint, a proximal portion that at least partially covers the proximal area, and a distal portion that at least partially covers the distal area; and a plurality of weight members positioned on the proximal and distal portions over the endogenous skeletal muscle on the adjacent proximal and distal areas of the body joint when the device is warn in such a manner that the amount of weight tapers toward the middle portion.

15. The device of claim 14, wherein at least a portion of the plurality of weight members comprise solid weight members having a relatively slim cross-sectional profile.

16. The device of claim 14, wherein the form-fitting sleeve is adapted to be comfortably worn over a knee joint and:

a first portion of the plurality of weight members is positioned on on anterior portion of the proximal portion of the form-fitting sleeve;

a second portion of the plurality of weight members is positioned on a posterior portion of the proximal portion of the form-fitting sleeve;

a third portion of the plurality of weight members is positioned on an anterior portion of the distal portion of the form-fitting sleeve; and a fourth portion of the plurality of weight members is positioned on a posterior portion of the distal portion of the form-fitting sleeve, and wherein each of the first, second, third and fourth portions of the plurality of weight members are spaced apart in relation to each other.

* * * * *